US006272943B1

(12) United States Patent
Lais et al.

(10) Patent No.: US 6,272,943 B1
(45) Date of Patent: Aug. 14, 2001

(54) DRIVE MECHANISM FOR A BARRIER

(75) Inventors: Lothar Lais, Schopfheim; Walter Schwald, Maulburg, both of (DE)

(73) Assignee: Magnetic Autocontrol GmbH, Schopfheim (DE)

( * ) Notice: Subject to any disclaimer, the term of this patent is extended or adjusted under 35 U.S.C. 154(b) by 0 days.

(21) Appl. No.: 09/484,365

(22) Filed: Jan. 14, 2000

Related U.S. Application Data

(63) Continuation of application No. PCT/EP97/03821, filed on Jul. 17, 1997.

(51) Int. Cl.[7] ..... E01F 13/00; E01F 9/00

(52) U.S. Cl. ..... 74/425; 74/606 R; 404/6; 404/9; 246/479

(58) Field of Search ..... 74/606 R, 425; 49/324; 246/479, 485; 256/13.1; 404/6, 9

(56) References Cited

U.S. PATENT DOCUMENTS

| | | | | |
|---|---|---|---|---|
| 4,226,136 | * | 10/1980 | Porter et al. | 74/425 |
| 5,570,606 | * | 11/1996 | Irie | 74/425 |
| 5,813,796 | * | 9/1998 | Kocznar | 404/6 |

FOREIGN PATENT DOCUMENTS

| | | |
|---|---|---|
| 83 00 704 U 1 | 4/1983 | (DE) . |
| 32 31 720 C1 | 11/1983 | (DE) . |
| 85 16 062 U | 7/1985 | (DE) . |
| 0 290 957 B1 | 7/1991 | (EP) . |
| 0 438 364 | 7/1991 | (EP) . |

* cited by examiner

*Primary Examiner*—David A. Bucci
*Assistant Examiner*—William C Joyce
(74) *Attorney, Agent, or Firm*—Henry M. Feiereisen

(57) ABSTRACT

A drive mechanism for a barrier or a stop or gate device includes a drive unit having a drive motor (17) to which at least one single-stage step-down gear, worm gear and/or spur gear with an articulation to a pivoting crank (38) is connected, with the crank being mounted on a primary shaft (46) pivoting preferably around a horizontal axis at bearing points on both sides. The shaft is provided with a fixing device (40) for the barrier beam (41) or gate element which can generally pivot at an angle of approximately 90° in addition to abutments for the compensation springs (48) which act upon their spring crank. The drive mechanism further includes a single-part, single-piece drive casing (G) with open, flat securing flange strips (2) on all sides and a receiving flange (14) to secure the drive motor (17) which can be dismantled and removed. The motor shaft (36) of the drive motor is introduced into a gear case (9) which can be closed by a cover (10) and which contains a set-down gear. An output crank (31) is fastened to the gear output shaft (30) and hingedly connected to the pivoting crank (38) of the drive shaft (46) by means of a swivelling arm (37). The pivoting crank (38) is mounted on both sides on bearing blocks (6) which are formed on the single-piece drive casing (G) and protrudes on one side at least in the area of the bearing point in addition to being provided with a fastening device (40) for the stop or gate member or barrier beam (41).

14 Claims, 9 Drawing Sheets

DRIVE MECHANISM FOR A BARRIER

CROSS-REFERENCES TO RELATED APPLICATIONS

This application is a continuation of prior filed copending PCT International application no. PCT/EP97/03821, filed Jul. 17, 1997.

BACKGROUND OF THE INVENTION

The present invention relates to a drive mechanism for a barrier or stop or gate device of the type disclosed, e.g., in European Pat. Nos. EP 0 290 957 B1, EP 0 438 364 B1, or German Pat. Nos. DE 32 31 720 C1 or DE 83 00 704 U1.

The invention is thus based on a device of the aforedescribed type having a drive assembly with a drive motor and a step-down gear having at least one stage. The step-down gear has an articulated connection to a pivoting crank disposed on a drive shaft which preferably pivots around a horizontal axis at bearing points on both sides. The drive shaft is provided with an attachment device for a closing element which can pivot about an angle of approximately 90 degrees or for the beam of the barrier, and with abutments for supporting compensation springs acting upon a respective spring crank.

The stationary components, the movable drive and the gear elements of the above-referenced drive mechanisms as well as other conventional drive mechanisms have a large number of individual parts. A large parts count is considered a disadvantage because of the many possible modifications and variations to be taken into consideration when the parts are procured. Moreover, assembly and adjustment of such a large number of parts is labor-extensive and costly.

A significant drawback resides in the fact that different sizes, different drive power and different designs, for example, for barriers rotating clockwise and counterclockwise, are required depending on the local conditions. This large number of possible variants requires a large inventory of individual parts, both in production and during installation, which results in high acquisition and storage costs. It is also expensive to stock spare parts and to maintain an extensive customer service with personnel familiar with the special features of the various types and variants and with the potential causes for a malfunction during installation or operation.

SUMMARY OF THE INVENTION

It is thus an object of the invention to provide an improved drive mechanism with a significantly reduced number of individual parts and which is universally applicable with same design and structure for different drive powers and barriers of different lengths and weights as well as different barrier locations either on the left-hand or right-hand side of the drive mechanism.

This object, and others which will become apparent hereinafter, are attained in accordance with the present invention by providing a one-piece and one-part drive casing having open flat securing flange strips on all sides and including a receiving flange for mounting the removable or detachable drive motor which has a motor shaft inserted into a gear case closeable by a cover and housing a step-down gear. An output crank is attached to the gear output shaft and connected in an articulate manner with the pivoting crank of the drive shaft through a swiveling arm, with the pivoting crank mounted on both sides on bearing blocks which are formed on the one-piece drive casing and with the pivoting crank protruding on one side at least in the area of the bearing points and provided with a fastening device for the stop or gate member or the barrier beam.

This configuration of the one-piece and one-part drive casing with the aforedescribed features realizes a drive mechanism as a compact unit which includes the drive motor, the encased step-down gear, a pivoting drive with an output crank, an articulated connection to the swiveling arm, and with bearings for the drive shaft for the stop or gate member or the barrier beam, respectively.

This structural unit is provided on all sides with open flat securing flange strips and can therefore be attached or anchored to sub-structures or other types of mounting devices.

Significant advantages can be realized with the one-part drive casing in conjunction with manufacture as a complete injection molded part, with mechanical machining in a clamping mechanism, and with maintaining tight dimensional tolerances and as well as with eliminating complex rechucking and adjustment tasks. The technical complexity is further reduced due to the significantly smaller number of individual parts that have to be assembled.

In an advantageous embodiment, a receiving flange is incorporated in combination with the gear case for the step-down gear for mounting the drive motor. Both assemblies can be machined using a single chuck so that precise tolerances can be maintained and the machining time can be kept to a minimum.

The receiving flange for mounting the drive motor may be formed as a cylindrical pipe socket which is oriented perpendicular to the axis of the drive shaft, with the stator housing of the drive motor inserted into the pipe socket of the receiving flange. In another modified embodiment, the pipe socket may be formed as a short pipe socket and provided with a circular centering shoulder for fittingly attaching and securing the stator housing of the drive motor by screws.

This configuration realizes in a simple manner the use of different motor types according to output, operating voltages, and motor type and its varying dynamic properties. The use of an inexpensive asynchronous motor suffices for simple barriers or gates used in parking garages with opening and closing times between 2 and 3 seconds, whereas an electronically controlled synchronous motor with a large dynamic torque can be used when faster movement times of approximately 0.5 seconds are demanded. DC motors may be used with solar powered devices.

Also incorporated in the one-part drive casing is a gear case for the step-down gear. The gear case includes an input bore for the motor shaft, layshaft gears and associated bearing points for at least one step-down stage, and an output bore for the gear output shaft which is cantilevered and provided with an output crank. Since the gear case and the receiving flange for the drive motor are machined in a single chuck, the gear wheel positioned on the motor shaft meshes precisely with the gear wheel of the first step-down stage supported in the gear case.

The gear case can be closed with a cover and includes the bearing points for the gears of the step-down gear mechanism forming the step-down stages. Preferably, two or three step-down stages are provided, wherein the output shaft of the end stage of the step-down stages is provided with an output crank disposed on the outside of the gear case.

The step-down gear mechanism is preferably constructed as a modular system comprised of a worm gear stage and two spur wheel stages, with the gear ratio of the worm gear stage and the spur wheel stages permitting a wide range of combinations of speed reduction ratios by interchanging wheel pairs.

The option of selecting the motor type in combination with a selectable gear reduction realizes a very broad range of adaptations to suit varying operating conditions of barriers or similar gate systems.

The output crank disposed on the outside of the gear case is hingedly connected via a swivelling arm to the pivoting crank and positioned on the drive shaft operating the barrier or another gate device. Both sides of the drive shaft are supported in abutments formed on the drive casing. Attached to an exposed side of the drive shaft is the barrier or other gate device by means of a fastening device.

According to another feature of the present invention, the drive shaft is formed as a hollow shaft for receiving an operating shaft in fixed rotative engagement. The operating shaft is connected to the fastening device for the barrier or gate element or barrier beam and can be pulled out to one side after being released and inserted again on the opposite side, so that the fastening device with the barrier or the gate element can be placed either on the left-hand side or on the right hand side as required, without requiring changes to the drive assembly. This provides advantages in the manufacture and logistics as a result of the reduced variety of configurations. Moreover, the user himself can switch the sides, while maintaining adjustment of the preset limit switches and transmitters for carrying out a proper operation.

In this context, it is advantageous to secure the output crank to the gear drive shaft and in particular to secure the pivoting crank to the drive shaft by clamping action. The cranks are formed as split ring flanges and releasably clamped to the drive shaft with screw connections. The operating shaft is locked using a safety element which is removed after the screw connection is released. The safety element is re-inserted, after changing the side of the operating shaft, and secured by tightening the screw connection.

The fastening device for a barrier beam or other gate device includes an adapter which is mounted in from-fitting manner to the operating shaft, and a connecting piece which has a complementary configuration and is suited with a spline profile to the adapter for the barrier beam or like gate device. By separating the adapter from the connecting piece, different designs and materials for a barrier beam (cross sectional profile/wood, metal, plastic) can be universally matched with one another.

In the event of an overload or impact of a force—for example, if a tree falls on the barrier beam or people sit on the barrier—excess forces are absorbed by a stop which in its lower position limits the end position of the pivoting crank and thereby prevents excess forces from being transferred to the gear mechanism.

Conventional drive devices for barriers or similar stop or gate devices typically require compensation devices for compensating unbalanced loads due to gravity. Spring compensation devices are usually employed. In accordance with another feature of the present invention, a spring compensation mechanism is provided which includes between one and six tension springs for attachment on two spaced-apart spring tie-bars, so that the spring compensation force can be matched to the degree of compensation required due to the gravity forces. A fine adjustment is provided by supporting the tension springs from anchor rods that can be adjusted with an adjustment screw.

The drive device according to the invention combines several synergetic measures into an advanced and novel technical solution which is not known in the art. It is thereby possible to provide a stop barrier or similar stop or gate device that can be easily adapted to a large number of installation and operating conditions, while at the same time reducing the complexity and the number of components.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
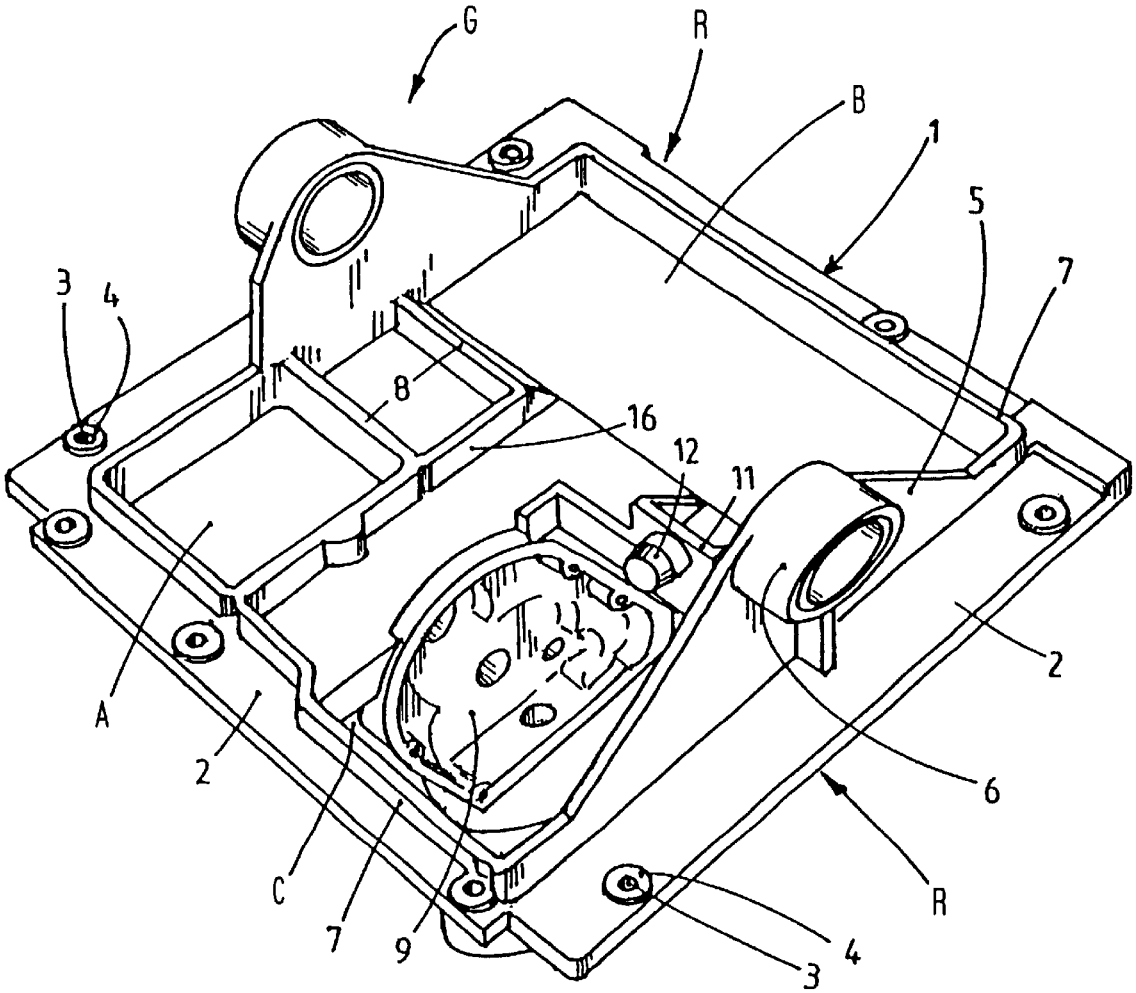
FIG. 1 is a perspective view of a first embodiment of a base configuration of a drive casing according to the present invention.

Throughout all the Figures, same or corresponding elements are generally indicated by same reference numerals.

Turning now to the drawing, and in particular to FIG. 1, there is shown a perspective view of a first embodiment of a base configuration of a drive casing G according to the present invention. The drive casing G is of single-piece construction and essentially includes a rectangular base frame 1 which is provided with flat securing flange strips 2 on all sides. The flange strips 2 have a plurality of spaced-apart bores 3 which are embedded in hole reinforcements 4. Arranged in opposite disposition via reinforcement ribs 5 are two bearing blocks 6 for supporting a drive shaft (not shown). The marginal regions R of the rectangular base frame 1 are also provided with reinforcement ribs 7 and interconnected by additional continuous reinforcement ribs 8 to prevent distortion, with compartments A, B and C being formed between the reinforcement ribs 7, 8.

Figure 7:
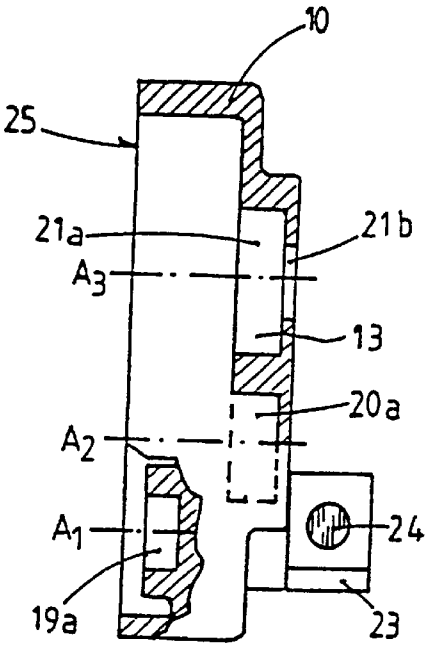
FIG. 7 is a cross-sectional view of the gear case cover, taken along the line VII—VII in FIG. 8.

Formed in the compartment C in perpendicular disposition to the plane of the base frame 1 is a gear case 9 which defines a planar casing opening closed by a gear cover 10, as seen in FIG. 7. Also shown is a limit stop 12 which is located in the region of the compartment C and disposed on a rib reinforcement 11. The limit stop 12 limits the swiveling motion of an output crank 31 (FIG. 9) which is secured to an gear output shaft 30 extending outwardly from an output bore 21*b* in the gear case cover 10 at bearing point 13.

Figure 2:
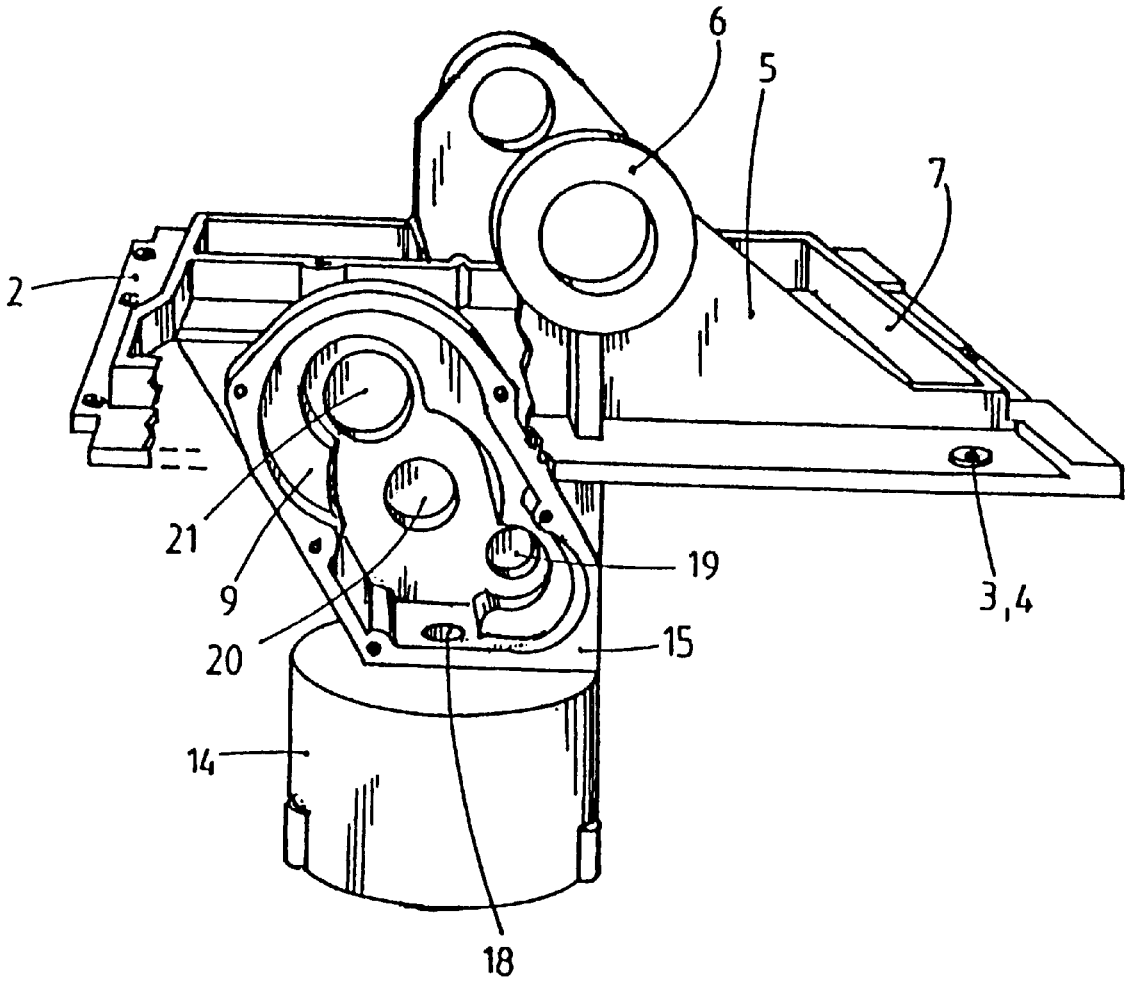
FIG. 2 is another perspective view of the drive casing of FIG. 1.

As shown in FIG. 2, the gear case 9 is formed on the base frame 1 via reinforcement ribs 15 and 16 (FIG. 1). Attached in one piece to the bottom side of the gear case 9 is a receiving flange 14 for attachment of a removable and/or detachable drive motor 17.

Figure 3:
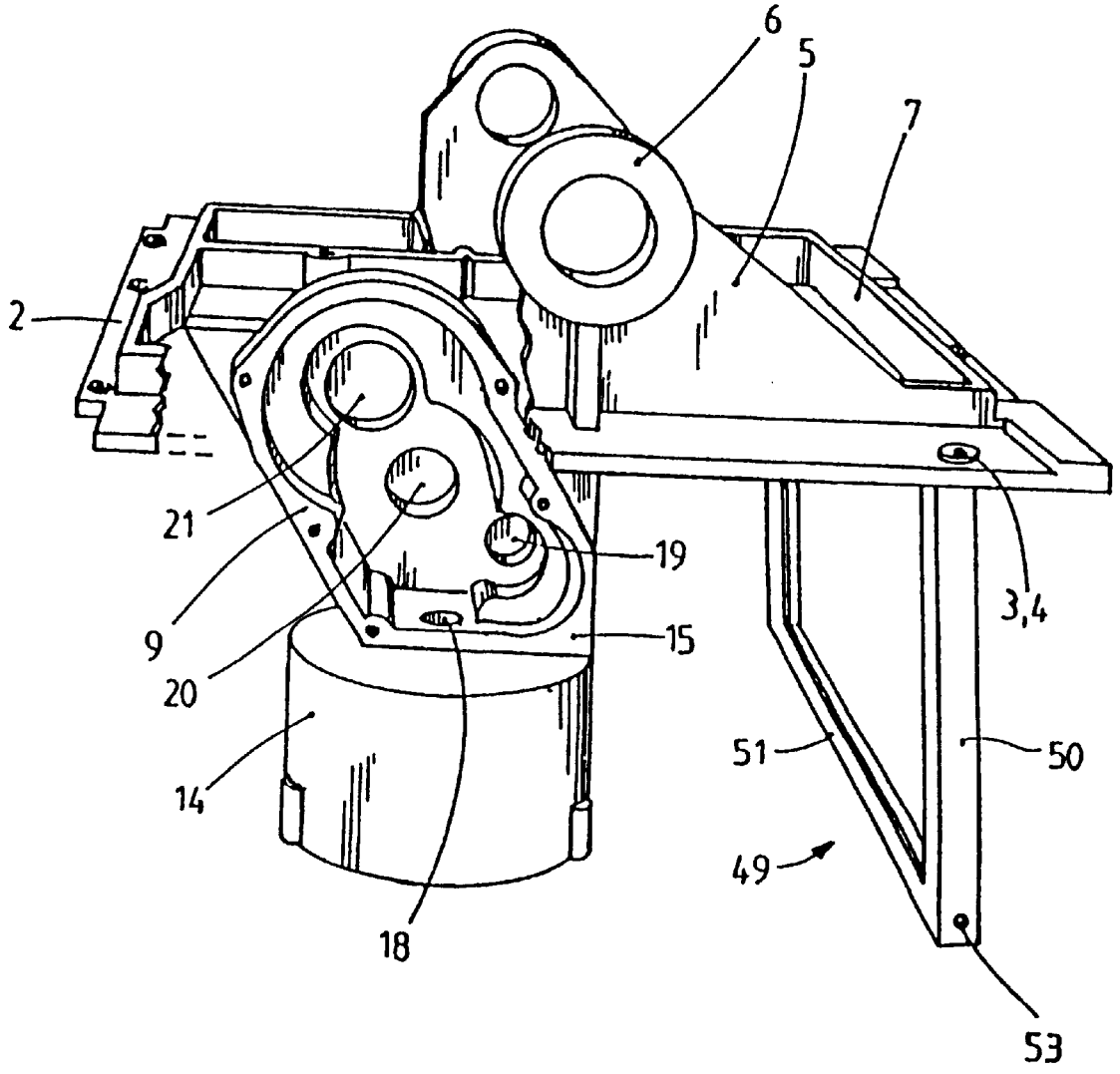
FIG. 3 is a perspective view of a second embodiment of a base configuration of a drive casing according to the present invention.
Figure 11:
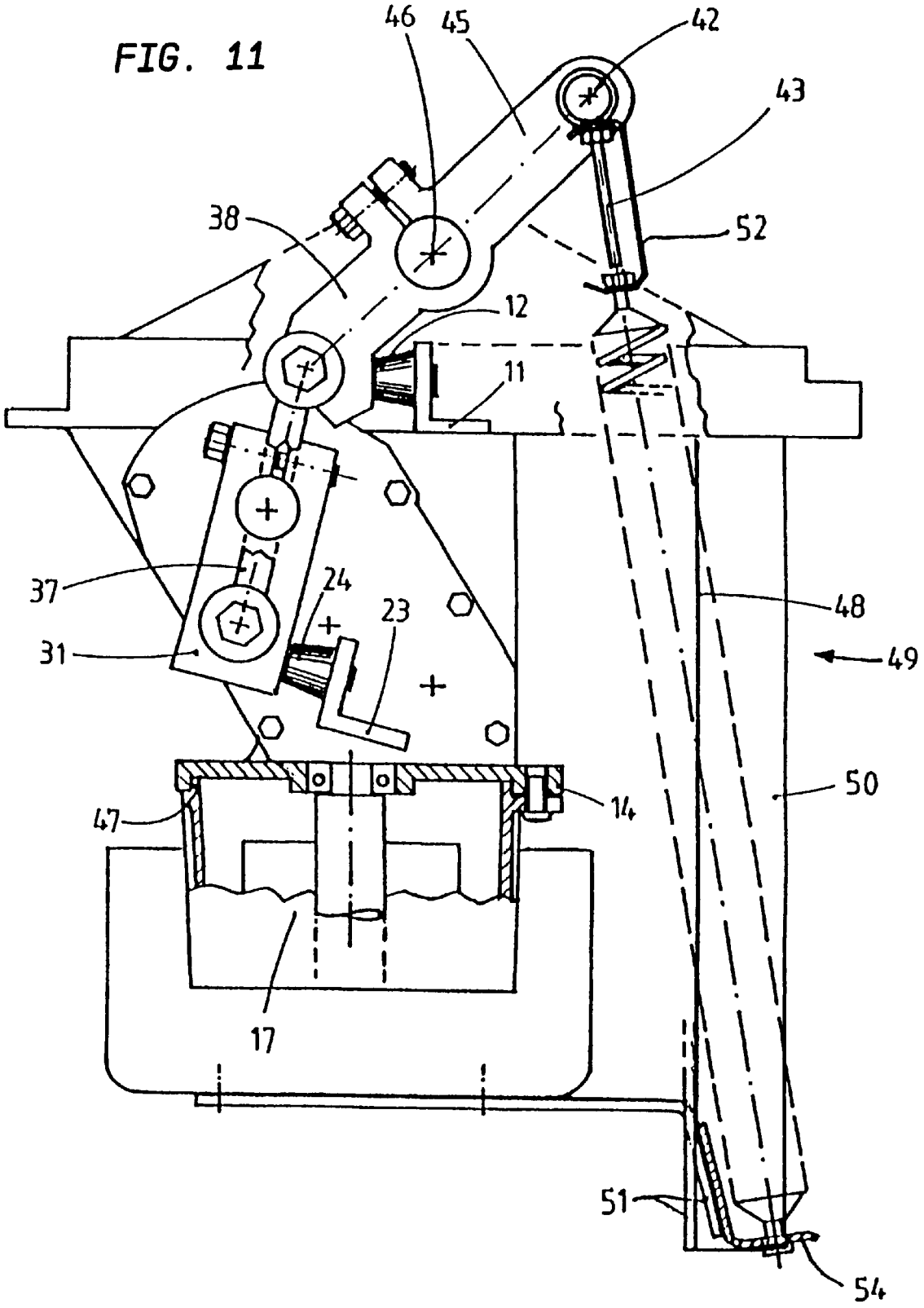
FIG. 11 is a side view of the drive gear mechanism.

FIG. 3 shows a variation of the drive casing G which has attached thereto a frame support, generally designated by reference numeral 49 and including two side walls 50 and a casing stay 51 for suspending compensation springs 48, shown in FIG. 11. The frame support 49 may be connected in one piece with the drive casing G, for example as a unitary injection molded part, or may be connected to the drive casing G via a plug or screw connection.

Figure 4:
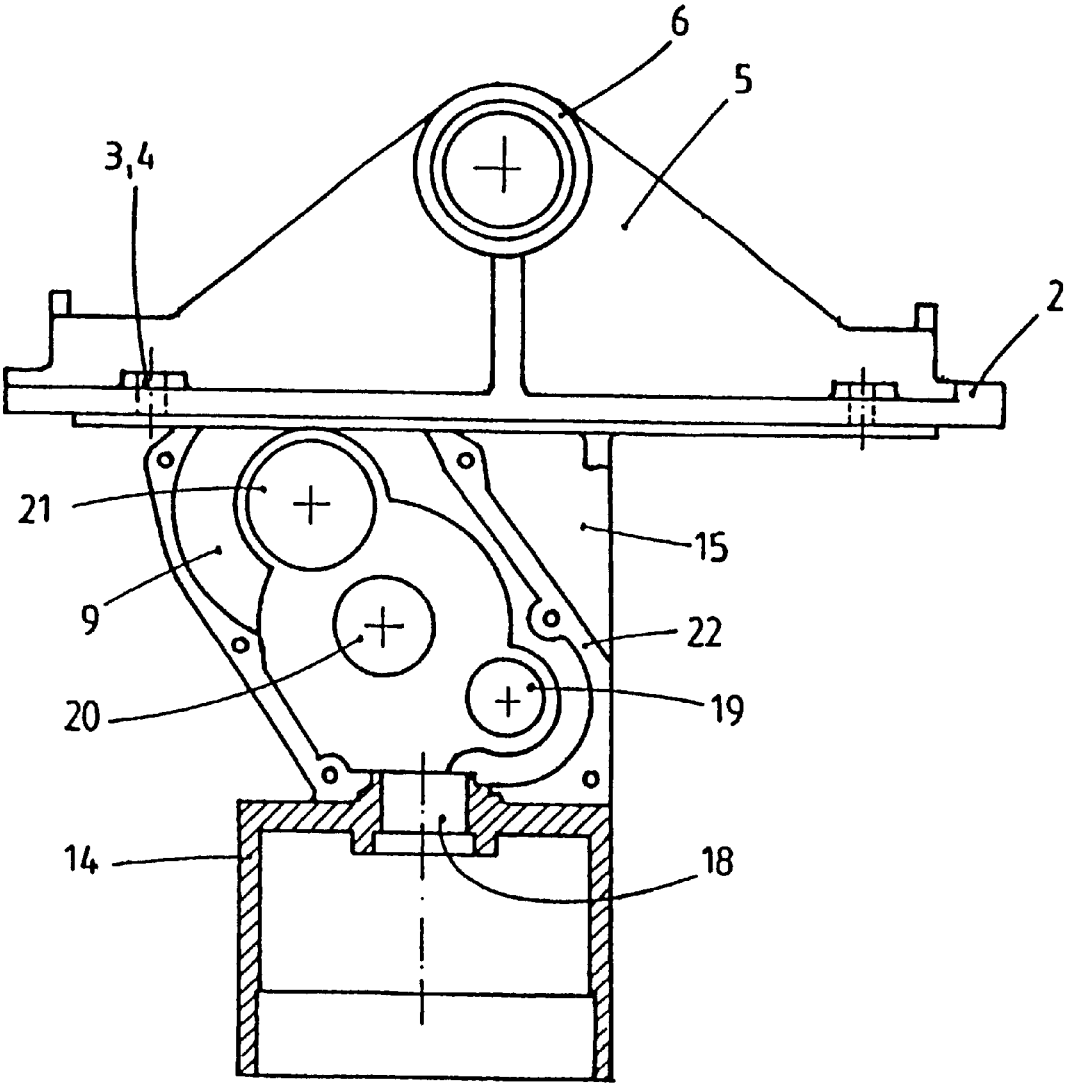
FIG. 4 is a side view of the drive casing of FIG. 1.
Figure 5:
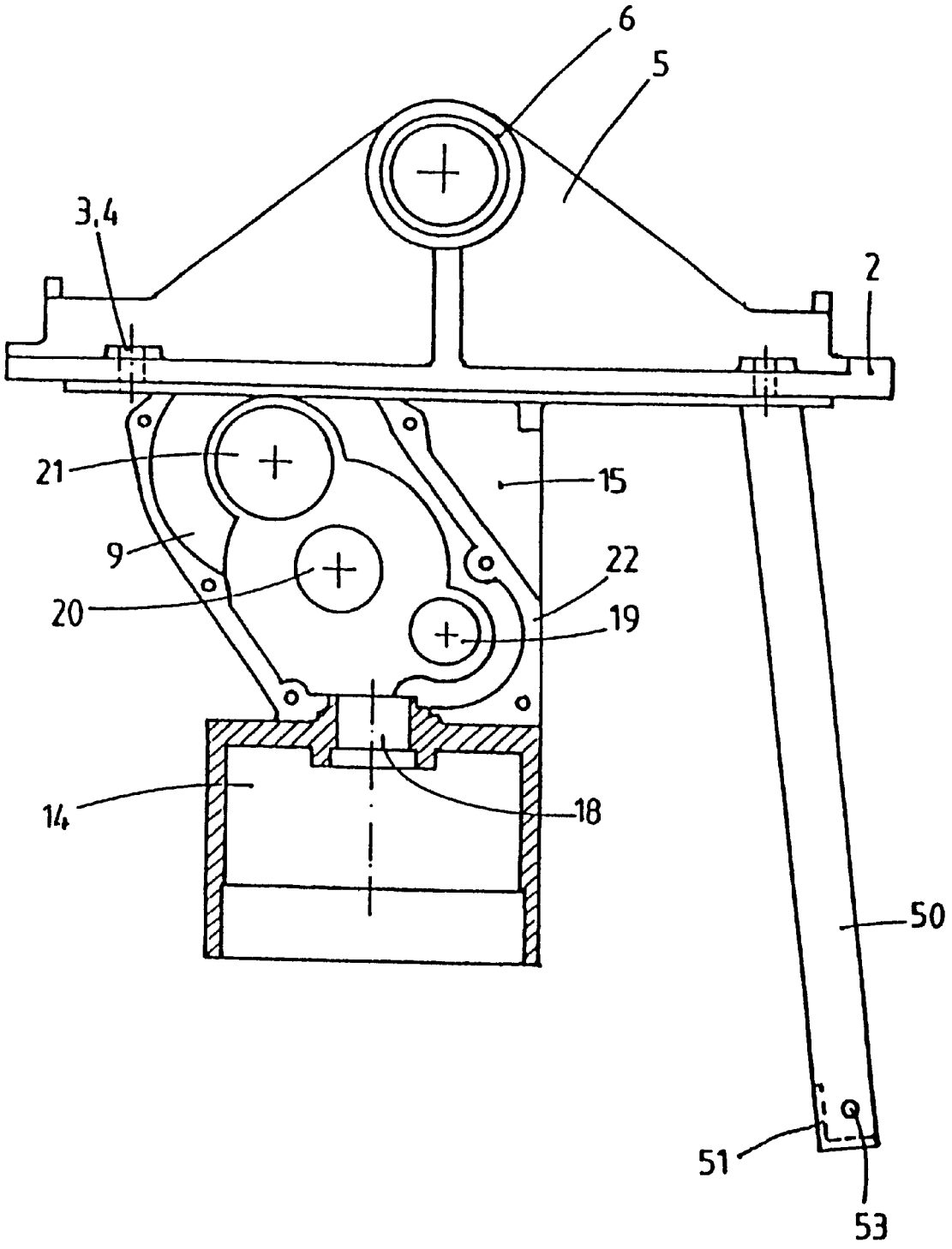
FIG. 5 is a side view of the drive casing of FIG. 3.

FIGS. 4 and 5 illustrate the one-piece construction of the drive casing G with the gear case 9 and the receiving flange 14 for mounting the drive motor 17. The planar outside surface 22 of the gear case 9 facilitates screw attachment of the gear case cover 10, as can be seen from FIGS. 6 to 8. The gear case 9 has an input bore 18 for insertion of the motor shaft, with a worm (not shown) fitted on the motor shaft. Bearing points 19 in the gear case cover 10 of the gear case 9 are provided to support the first layshaft (not shown) which includes the worm gear and the first pinion. Bearing points 20 and 20*a* receive the roller bearings for the second layshaft with a gear wheel and another pinion, whereas bearing points 21 and 21*a* receive roller bearings for the gear output shaft which supports a spur gear in the gear case 9. The gear output shaft extends outwardly through the output bore 21 and is provided with the output crank 31. The gear cover 10 also includes a projection 23 with a limit stop 24 which limits the movement of the output crank 31.

Figure 9:
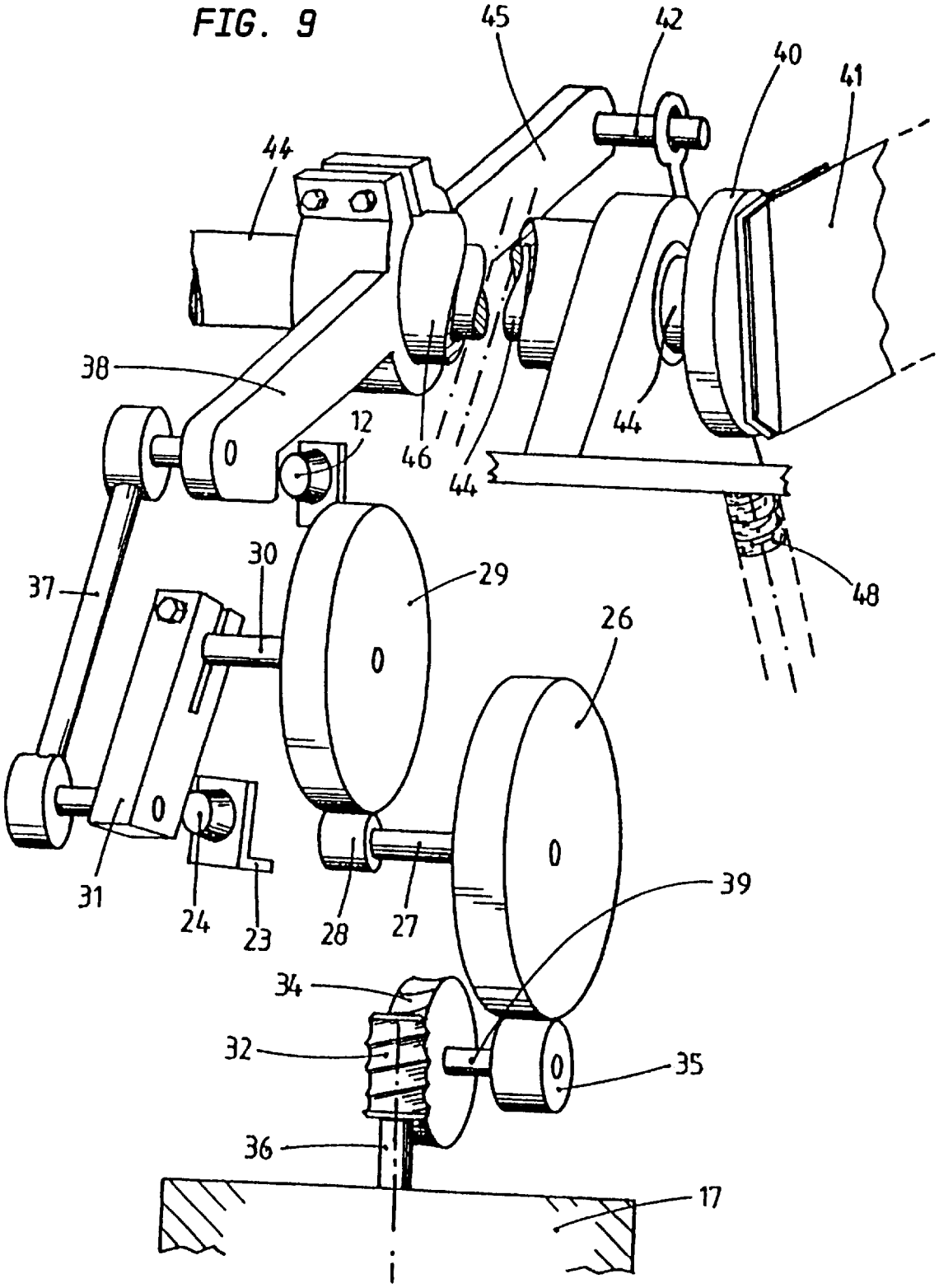
FIG. 9 is a schematic illustration of a drive mechanism in accordance with the present invention.
Figure 10:
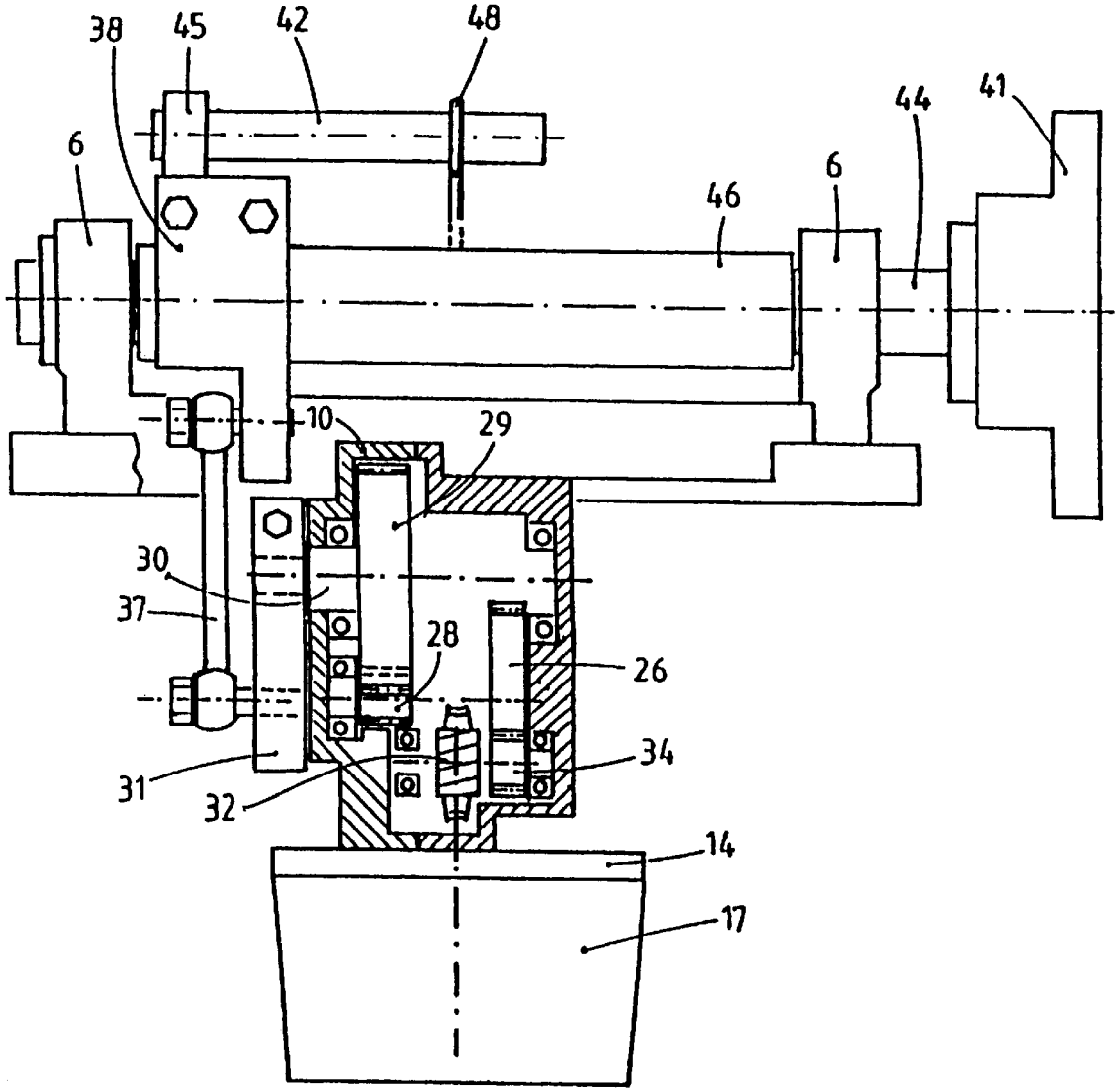
FIG. 10 is a partial section of a drive gear mechanism in accordance with the present invention.

FIGS. 9 to 11 show the drive mechanism of the device for the illustrated embodiment. Reference numeral 36 denotes the motor shaft of drive motor 17, with worm 32 being mounted on the motor shaft 36. The worm 32 meshes with worm gear 34 which is connected via the worm gear shaft 39 with the pinion 35. The pinion 35 meshes with the spur gear 26 located together with the pinion 28 on the layshaft 27. The pinion 28 drives the spur gear 29 located on the drive output shaft 30 and thereby also the output crank 31. The torque is transmitted via swiveling arm 37 to pivoting crank 38 which is connected to the drive shaft 46. The drive shaft 46 is formed as a hollow shaft, with the operating shaft 44 removably arranged in and releasably connected in fixed rotative engagement to the hollow drive shaft 46. Disposed on the operating shaft 44 is the fastening device 40 for the barrier beam 41. A spring crank 45 is provided in prolongation of a pivoting crank 38 for attachment of the upper spring tie bar 42 from which the compensation springs 48 are suspended.

The drive shaft 46 can be withdrawn together with the fastening device 40 and the barrier beam 41 from the operating shaft 44 in order to change the barrier beam 41 from left to right, without requiring an adjustment of the drive mechanism on the drive shaft 44 or release of the drive shaft 44.

Figure 8:
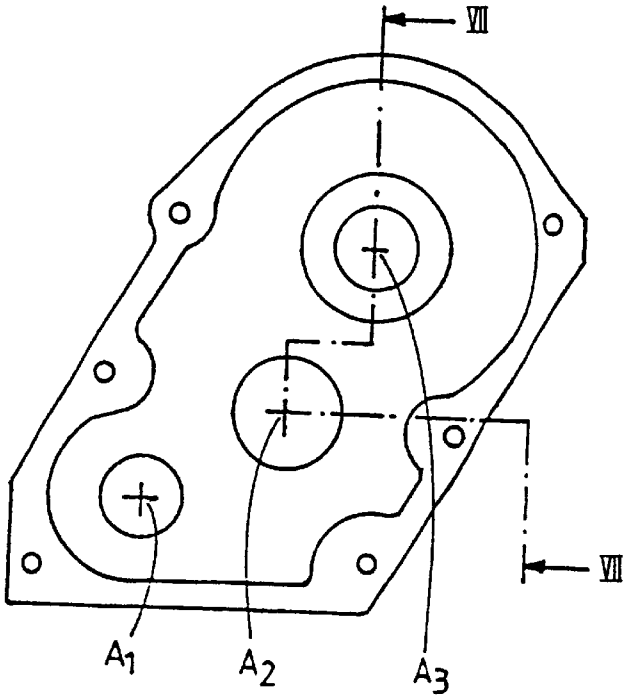
FIG. 8 shows the gear case cover as viewed from inside.
Figure 6:
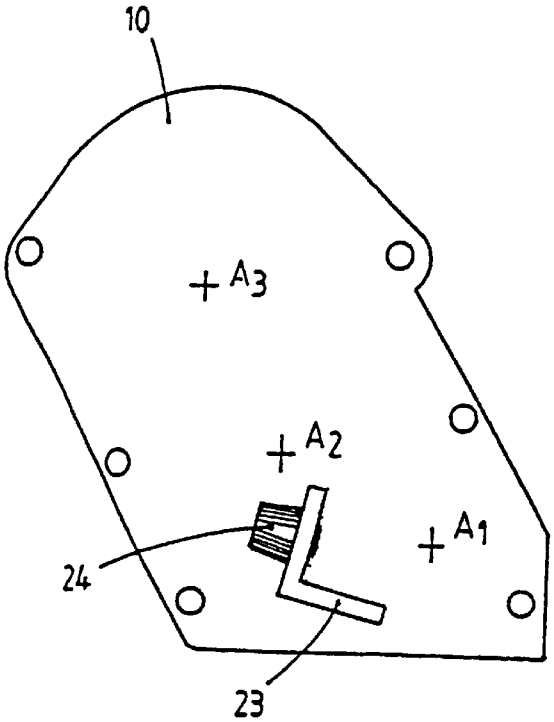
FIG. 6 is a side view of a gear case cover.

This kinematics is also shown in a partial view in FIG. 10, with the gear case 9 and the gear cover 10 shown by way of a vertical section. Also depicted in the FIG. 10 is the manner in which the worm gear shaft 39 (not shown in detail) and the gear shaft 27 (also not shown) are supported in the corresponding bearing points 19, 19*a* and 20, 20*a* by roller bearings. The gear output shaft 30 is supported in the bearing points 21, 21*a*. (FIGS. 6 to 8)

The gear components in FIG. 11 have the same reference numerals. As also seen, unlike the embodiment of FIGS. 2 to 5, the receiving flange 14 is formed as a short pipe socket for centered attachment of the casing of the drive motor 17. Also illustrated is the spring crank 45 with the upper spring tie bar 42 from which the compensation springs 48 are suspended. The length of the screw connections 43 which are attached to the spring tie bar 42 and connected to the spring ends, can be adjusted to permit an adjustment of the spring force. Similar screw connections can also be disposed on the lower spring tie bar 54 which is connected to the casing stay 51 or supported in a bore 53, respectively. Reference numeral 52 denotes a bracket for attachment of the compensation spring 48.

While the invention has been illustrated and described as embodied in a drive mechanism for a barrier, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A drive mechanism for operating a barrier, comprising:

a drive assembly including a drive casing formed as a single part and having side faces formed on each side of the drive casing;

a casing stay connected in the transverse direction with the side faces;

a drive motor;

a receiving flange formed on the drive casing and adapted to receive the drive motor;

a gear case formed on the drive casing and having a gear drive shaft, a gear output shaft and an at least single stage step-down gear defining a gear ratio between the gear drive shaft and the gear output shaft; and a cover for closing the gear case;

an output crank fastened to the gear output shaft;

a drive shaft supported at bearing supports for pivoting around a horizontal axis, wherein the drive shaft has an articulated connection with the output crank and includes an attachment device for attachment of the barrier, a pivoting crank disposed on the drive shaft;

a spring crank rigidly connected to the pivoting crank and receiving an end of a compensation spring; and a lower spring tie-bar connected to the drive assembly for receiving the other end of the compensation spring.

2. The drive mechanism of claim 1, wherein the bearing supports are integrally formed on the drive casing.

3. The drive mechanism of claim 1, wherein the output crank is connected to the pivoting crank by a swivel arm.

4. The drive mechanism of claim 1, wherein the barrier rotates about an angle of approximately 90°.

5. The drive mechanism of claim 1, wherein the receiving flange for mounting the drive motor is formed as a cylindrical pipe socket which is oriented perpendicular to an axis of the drive shaft.

6. The drive mechanism according to claim 5, wherein a stator housing of the drive motor is inserted into the pipe socket.

7. The drive mechanism of claim 5, wherein the pipe socket is formed as a short pipe bore and provided with a circular centering shoulder for receiving a stator housing of the drive motor.

8. The drive mechanism of claim 1, wherein the drive casing comprises an input bore for a shaft of the drive motor, layshaft gears and a plurality of bearing supports for at least one step-down stage, and the gear cover is provided with an output stub for the gear output shaft.

9. The drive mechanism of claim 1, and further comprising an operating shaft which is releasably inserted into the drive shaft so as to be movable in an axial direction relative to the drive shaft, but prevented from rotating relative to the drive shaft, wherein the attachment device is non-rotatably connected to the operating shaft.

10. The drive mechanism of claim 1, wherein the output crank is clamped to the gear drive shaft.

11. The drive mechanism of claim 1, wherein the pivoting crank is clamped to the drive shaft.

12. The drive mechanism of claim 1, further comprising an upper spring tie-bar for attachment of the compensation spring, with the upper spring tie-bar connected in an articulated manner with the spring crank.

13. The drive mechanism of claim 1, wherein the lower spring tie-bar is secured to the drive casing.

14. The drive mechanism of claim 1, wherein the step-down gear comprises a first step-down stage with a worm gear disposed on the motor shaft and a worm wheel, and a second step-down stage formed of a first pinion and a first spur wheel, and a third step-down stage with a second pinion and a second spur wheel, wherein the second spur wheel is located on the gear output shaft.

* * * * *